United States Patent [19]

Covy

[11] 4,250,714

[45] Feb. 17, 1981

[54] METHOD FOR COOLING METAL TURNINGS

[76] Inventor: Allan P. Covy, 2120 Paseo Del Mar, Palos Verdes Estates, Calif. 90274

[21] Appl. No.: 36,144

[22] Filed: May 4, 1979

[51] Int. Cl.[3] ..... F25D 25/00

[52] U.S. Cl. ..... 62/62; 62/64; 62/70; 62/78; 62/240; 169/45; 169/66; 220/88 B

[58] Field of Search ..... 62/62, 64, 69, 70, 78, 62/373, 240; 220/88 B; 169/45, 62, 66, 91; 82/1 C, DIG. 1, DIG. 2

[56] References Cited

U.S. PATENT DOCUMENTS

| | | | |
|---|---|---|---|
| 2,261,808 | 11/1941 | Morris | 62/64 |
| 2,978,336 | 4/1961 | Morrison | 62/64 |
| 3,285,711 | 11/1966 | Stanford | 220/88 B |
| 3,788,039 | 1/1974 | Bragg | 220/88 B |

OTHER PUBLICATIONS

*Information Concerning the Proper Handling of Short Shovel Turnings in Export Cargoes,* National Cargo Bureau, Jul. 1, 1965.

*Primary Examiner*—Ronald C. Capossela
*Attorney, Agent, or Firm*—Lyon & Lyon

[57] ABSTRACT

A pile of scrap turnings can undergo exothermic reactions, especially when wet. To reduce the temperature of the pile, an inert gas, preferably nitrogen, is introduced into the pile. This technique is particularly useful for a pile of turnings in a ship's hold. This technique can be used either alone, or in conjunction with introduction of nitrogen into the turnings as they are loaded into the ship's hold.

31 Claims, 3 Drawing Figures

METHOD FOR COOLING METAL TURNINGS

BACKGROUND

This invention relates to the handling of marine cargoes, and particularly ferrous metal turnings.

Ferrous turnings are a form of metal scrap generated in various machine shop operations and then crushed or processed in other ways to prepare them for shipment and remelting in a furnace. As normally collected by scrap dealers and available commercially, they are a heterogenous mixture of many types of carbon steels and contain minor amounts of various cutting oils and coolants. The turnings can be contaminated with cast iron borings, rust, non-ferrous metals, and organic materials.

Ferrous turnings when stored can generate heat by undergoing exothermic reactions. This is particularly true when a large mass of turnings are piled together in a confined space, as for example a ship's hold. A ship's hold can contain in excess of 2,000 long tons of turnings, and often from 10,000 to 20,000 long tons of turnings. The exact nature of the exothermic reactions which a pile of turnings undergoes is not known. However, it is believed that heat is generated due to rusting of the steel, particularly when water is present, and decomposition of the cutting oils. It has been noted that volatile gases, including hydrogen, can be given off when a pile of turnings reaches an excessively high temperature in the neighborhood of 300° to 400° F.

For over thirty years, the tendency of a pile of turnings to heat up has been a serious problem for the shipping industry. The danger of a fire or explosion at sea or in port is of great concern. For example, on Jan. 21, 1970, a fire occurred in the Norwegian N.V. "Pontos" in Los Angeles due to turnings which had reached a temperature in excess of 500° F. in the hold. A fire occurred in which the flames reached a height of 30 feet above the hatch coaming. The vessel was saved only by flooding the hold with water and unloading the turnings from the vessel.

Until my invention, which is described below, there has been no satisfactory solution to the problem. The solution used by the U.S. Coast Guard is to prevent a vessel from sailing if the turnings in the hold have an excessively high temperature. This means that a ship loaded with hot turnings must sit in port, with the hold open, until the turnings cool down by heat transferred to the surroundings. According to Title 36 of the U.S. Code of Federal Regulations, Section 148.04-13, which deals with loading of metal borings, shavings, turnings, and cuttings into a ship, these materials cannot be loaded if the temperature of the material is not less than 130° F. Furthermore, the vessel cannot leave port unless "the temperature of each article in each hold is less than 150° F. and, if the temperature of the article in the hold has been more than 150° F. during loading, the temperature of each article has shown a downward trend below 150° F. for at least 8 hours after completion of loading of the hold . . . "

Waiting in port for turnings to cool can be very expensive. Vessels have had to sit in port for one to two months at costs well in excess of $100,000 while waiting for turnings to cool.

In spite of the precautions mandated by the Coast Guard, the danger of fires from hot turnings remains a potentially serious problem. In response to this danger, the Canadian government has banned ships carrying turnings from the St. Lawrence Seaway. The Canadian government is concerned that a ship carrying turnings could catch fire and explode in one of the locks, and thereby close down the seaway. Such a regulation is also under consideration for the Panama Canal. Furthermore, because of the danger of fires, insurance underwriters charge a premium for ships carrying turnings.

In view of the above, there is a need for a method for preventing turnings from heating up in a ship's hold, and for a method for cooling down hot turnings.

SUMMARY

I have now invented a method that solves the problem of how to reduce the temperature of ferrous turnings in a ship's hold and other locations. The method comprises the step of introducing an inert gas, preferably nitrogen, directly into the pile of ferrous turnings, preferably at a plurality of locations in the pile. At least one of the locations is at a level below the elevation of the center of mass of the pile. Preferably at least a portion of the gas is introduced laterally into the pile.

For a large pile, such as found in a ship's hold, a plurality of pipes are driven into the pile, where each pipe has at least one orifice in its wall. At least a portion of the orifices are at a level below the elevation of the center of mass of the pile.

This technique solves the problem once a pile of turnings reaches a temperature higher than desired, such as the 150° F. limit set by the U.S. Coast Guard. Furthermore, I have also invented a technique which prevents the turnings from reaching a temperature in excess of 150° F. during loading. According to this technique, gas introducing means are provided in the ship's hold even before the turnings are loaded into the hold. Then, as the turnings are loaded into the hold to form a pile of turnings, gas is introduced into the pile of turnings from the gas introducing means. This technique can be used in stages, where after a first layer of turnings has been placed into the hold, a second gas introducing means can be placed upon the first layer. Then a second load of turnings can be introduced into the hold while introducing gas from the second gas introducing means. If desired, the first gas introducing means can be used while loading the second layer of turnings.

DRAWINGS

These and other features, aspects, and advantages of the present invention will become better understood with reference to the following description, appended claims, and accompanying drawings where:

DESCRIPTION

Figure 1:
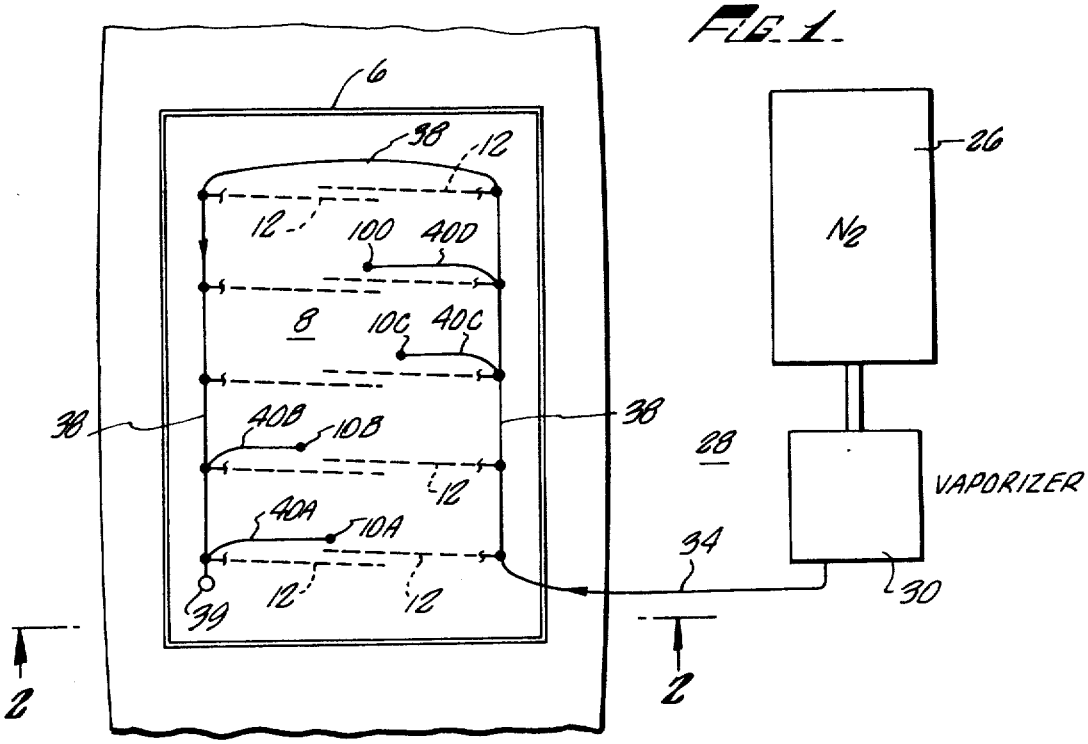
FIG. 1 is a plan view of a ship's hold containing ferrous turnings where nitrogen is being introduced into the turnings.

The present invention is directed to a method for reducing the temperature of a pile of ferrous turnings exposed to the atmosphere. The method is particularly useful for large piles of turnings, such as those containing at least 10 long tons of turnings, and particularly useful for piles containing at least 1,000 long tons of turnings. My method comprises the step of introducing an inert gas directly into the pile at a plurality of locations in the pile. At least one of the locations is at a level below the elevation of the center of mass of the pile.

As used herein, the term "turnings" means discrete pieces of metal which when stored in large quantities can exhibit exothermic reactions that result in an increase in bulk temperature. Included in this definition are metal borings, shavings, turnings, and cuttings as included in the U.S. Code of Federal Regulations, Title 46, Section 148.04-13.

As used herein, the term "inert gas" means a gas which is substantially free of molecular oxygen. Exemplary of inert gases are steam, nitrogen, argon, carbon dioxide, and combinations thereof. Preferably the inert gas used in the method of this invention does not contain any oxygen, because it is believed that a gas containing oxygen can decompose in the presence of metal turnings at elevated temperatures to release oxygen. Therefore, preferably the inert gas used is not carbon dioxide and/or steam.

The preferred inert gas in nitrogen because it is readily available at reasonable cost. Furthermore, nitrogen is available as liquid nitrogen. The liquid nitrogen can be introduced directly to a pile of turnings as a liquid or it can be vaporized first. In either state, the low temperature of the nitrogen helps to cool the turnings.

Although not bound by theory, it is believed that introduction of nitrogen directly into a pile of turnings can reduce the temperature of the pile by preventing some oxidation reactions from occurring. It is believed that the nitrogen displaces oxygen present in the pile. Furthermore, the lowering of the temperature from the cooling effect of the nitrogen slows the rate at which reactions do occur, and thereby slows the rate at which heat is generated by the pile of turnings. It is not known if the displacement of oxygen by the nitrogen has any effect on the rusting of the pile of turnings.

As described in more detail below in Example 1, this method has been shown to work. However, when I first proposed this solution to the problem of hot turnings, I was met with a great deal of skepticism, and in some cases, hostility. In response to my proposed solution, the following objections were made:

1. It would be impossible for the nitrogen gas to permeate a pile of turnings because of the high bulk density of the pile. It is known that a pile of turnings has a bulk density in the order of about 110 pounds per cubic foot.

2. The cold nitrogen gas would damage the ship's structure.

3. The cold nitrogen gas would damage the turnings by causing crystalization, thereby reducing their market value.

4. The cold nitrogen gas would be dangerous to ship's personnel, both from the low temperature and the lack of an oxygen atmosphere.

5. Introducing nitrogen into the pile of turnings would be ineffective, because the surface of the turnings would still be exposed to oxygen because it is necessary, according to Coast Guard regulations, to keep the hatch open. Furthermore, it was commonly believed that the maximum temperature was at the surface of the turnings, not in the interior of the turnings, because "heat rises". Therefore, it was thought that it would be useless to introduce nitrogen into the pile.

6. It would be impossible to obtain access to the interior of the pile of turnings because the turnings would bind any drill used.

7. Drilling a hole into the pile of turnings for introduction of nitrogen would aggravate the heat problem because of heat generated by friction during the drilling operation and the introduction of fresh oxygen into the turnings during drilling.

As described in more detail below, I have learned that these objections were ill-founded.

Although the present invention is particularly useful for cooling piles of turnings in a ship's hold, it is also useful for cooling piles of turnings in trucks and railroad cars. As noted above, it is not permissible to load turnings into a ship's hold if the temperature of the turnings is greater than 130° F. Thus, the technique can be used for cooling a load of turnings so that the load can be placed into a ship's hold.

The size of the pile of turnings can be as small as 10 long tons in the case of turnings loaded in a truck. In the case of ships, typically the ship contains at least 2,000 long tons, and cargoes of 10,000 to 20,000 long tons are not uncommon.

The conventional wisdom has been that the highest temperatures in a pile of turnings are usually found at the top of mounds. However, contrary to conventional wisdom, as demonstrated below, I have learned that hot spots generally are in the middle of the mass. To cool down these hot spots, preferably the nitrogen is introduced directly into the hot spots. Hot spots can be found by inserting temperature probes into the mass. To be sure to cool down the center of the mass, preferably at least a portion of the nitrogen is introduced into the pile of turnings at a level below the elevation of the center of mass of the pile.

The nitrogen introduced does not need to provide a "blanket" over the turnings. The hatch of a ship is necessarily left open during this process due to Coast Guard regulations. Therefore, oxygen is present in the hatch. Also, because of the relative impermeability of the mass of turnings, a nitrogen blanket is not formed. Nevertheless, my technique is effective.

Preferably, the turnings are covered with a tarpaulin or other covering to reduce the rate at which nitrogen is dissipated to the atmosphere. It has been found that the rate at which the turnings cool is faster when a tarpaulin is used.

To introduce nitrogen into the pile, a plurality of pipes, each pipe having a plurality of holes or orifices through its walls, are placed in the ship's hold. The pipes can be placed before, during, or after the turnings are loaded into the ship. Preferably at least a portion of the orifices are below the center of mass of the pile of turnings so that gas can be introduced into the hot spots.

When the pipes are provided after the turnings are loaded, they can be driven in with jackhammers. This technique has been found satisfactory with nominal 1 inch diameter carbon steel pipe. A pointed metal tip is placed on the end of the pipe to assist in penetration of the pile.

It has been found that introduction of nitrogen laterally or horizontally into the pile from vertically oriented pipes is particularly effective in quenching a pile of turnings. Therefore, preferably at least a portion of the nitrogen is introduced laterally.

The nitrogen can be provided as either liquid nitrogen or gaseous nitrogen. As described below, in the test conducted, a source of liquid nitrogen was provided, and the liquid nitrogen was vaporized in a vaporizer before it was introduced into the ship's hold.

During the cooling, preferably the temperature of the pile is intermitently or constantly monitored to determine the effectiveness of the cooling and make sure the hot spots are cooled. Temperatures should be taken at least 3 feet below the surface of the pile to obtain accurate readings.

The exact quantity of nitrogen required for cooling a pile of turnings depends on many factors. Among these factors are air temperature, ventilation, water temperature, settling of cargo, movement of water past the hull, presence of external sources of heat such as engine room bulkheads and fuel oil tanks, initial temperature of the turnings, compaction of the turnings, the make-up of the turnings, presence of contaminants such as cutting oils and non-ferrous metals, and the temperature of the nitrogen when it is introduced. It is believed that only from about 0.002 to about 0.2 pound of nitrogen per pound of turnings is required to achieve cooling below 150° F. Generally more than about 0.01 pound of nitrogen per pound of turnings is required, and preferably in the order of about 0.02 pound of nitrogen per pound of turnings is used. At quantities significantly less than about 0.02 pound of nitrogen per pound of turnings, inadequate cooling can occur. However, excessive use of nitrogen is foolish because of the cost and expense required.

The nitrogen can be introduced into the turnings as they are being loaded or after they are loaded. In one method according to the present invention, high temperatures are avoided by cooling the turnings as they are loaded into a ship's hold. This can be effected by preplacing near the bottom of the ship's hold gas introducing means. The gas introducing means can be a grid of 1 inch carbon steel pipe having upwardly directed orifices. The grid is connected to a source of inert gas such as nitrogen. Turnings can be loaded directly onto the grid and when the grid is at least partially covered with the turnings, nitrogen can be introduced into the turnings. After the turnings have been loaded to a selected depth, in the order of about 6 feet, the turnings can be leveled by equipment such as a bulldozer. Then a second grid can be placed on this first layer of pile of turnings, and the second grid can be connected to a source of nitrogen. Additional turnings can be loaded onto the second grid, and as this is occurring nitrogen can be introduced via the second grid. Simultaneously, nitrogen can be introduced via the first grid. The orifices of the second grid can direct nitrogen upwards, laterally, and downwardly. A suitable grid is believed to be one on a rectangular 6 foot pattern, i.e. a plurality of pipes in one direction spaced 6 feet apart from each other, and a plurality of crossing pipes spaced apart 6 feet from each other.

This process can be repeated as often as necessary, with additional grids being provided where desired, and an additional layer of turnings being loaded onto each additional grid.

After completion of the cooling operation, whether it be cooling turnings after they are loaded or cooling turnings as they are loaded, the gas introducing means can be left in the pile of turnings. For this purpose, preferably low cost carbon steel pipe is used.

These and other features of the present invention will become better understood from the following examples.

EXAMPLE 1

Figure 2:
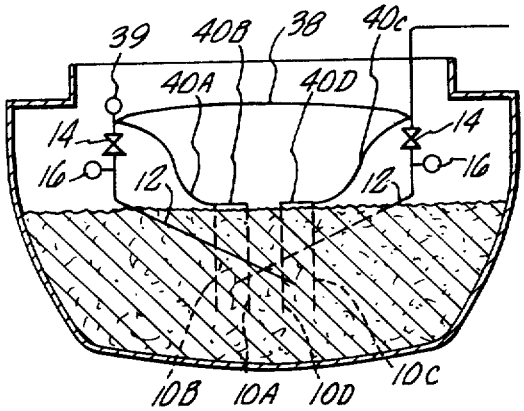
FIG. 2 is a view taken along line 2—2 of FIG. 1.

The following is an account of procedures and events concerning the loading of the Panamanian flag M/V Pacific Sunrise with a full cargo of scrap metals including ferrous metal turnings in hold number 1 at Berth LB 31 in the port of Long Beach, Calif. from the period Mar. 12, 1979 until Apr. 22, 1979. FIGS. 1 and 2 are a plan view and a view from aft forward, respectively, of hold No. 1 of the Pacific Sunrise. The turnings pile prior to transport to the Pacific Sunrise was stored out in the open. For several months prior to March 12, very heavy rains were experienced and unquestionably the pile of turnings was substantially saturated by rainfall. The turnings were moved from Los Angeles to shipside in Long Beach in open gondola railroad cars. These cars were wetted by rain in transit from Los Angeles and also were wetted by rain as they waited in storage to be loaded, and in instances were rained on while being loaded. This wetness is of tremendous importance because wetness is believed to be very active in accelerating the exothermic reactions which take place in metal turnings. The turnings were loaded into the railroad cars by an electromagnet which swung then through the air, thus subjecting the turnings to atmospheric oxygen. This procedure was used in discharging the railroad cars and loading the turnings into the vessel so that the same turnings were again given maximum oxidation exposure.

As per Federal Regulations, three temperatures were taken of each railroad car before loading and any car with a temperature above 125° was rejected, even though the Regulations said 130°. While taking these temperatures it became obvious that exothermic reactions were taking place in these turnings due to the extremely high temperature that were recorded in some of the railroad cars. There were 52 railroad cars and 6 contained turnings having a temperature greater than 125° F. Temperatures in excess of 200° F. were noted.

Loading into hold number 1 of the vessel commenced at 1800 hours on Mar. 12, 1979. The capacity of the hold 6 was 163,755 grain cubic feet. The hold was loaded with 2639.04 long tons of turnings 8 occupying a volume of about 80,000 cubic feet and a depth of about 20 feet. Temperatures were taken in the hold of this vessel on completion of loading and daily at approximately 0700 hours, except when compacting. Forty-eight places were tested in each testing except as noted below. The following is a daily account of the temperatures giving the high temperature, the mean average and the number of places over 150° F.

Table 1

| | Date | Air Temperature | High Temperature | Mean Average | No. of Places Over 150° | Remarks |
|---|---|---|---|---|---|---|
| | 3/13 | 66 | 85 | 80 | none | |
| | 3/14 | 65 | 76 | 72 | none | |
| | 3/15 | 68 | 158 | 98 | 2 | |
| 300 hrs | 3/15 | 68 | 200 | 111 | 5 | |
| | 3/16 | 66 | 208 | 187 | 21 | |
| 700 hrs. | 3/17 | 68 | 212 | 149 | 21 | |
| | 3/17 | 71 | 211 | 160 | 28 | |
| | 3/18 | 64 | 200 | 141 | 9 | |
| | 3/19 | | | | | Hatch closed on account of rain. |
| | 3/19 | 58 | 210 | 161 | 8 | Hatch closed on account of rain. Only 16 |

Table 1-continued

| | Date | Air Temperature | High Temperature | Mean Average | No. of Places Over 150° | Remarks |
|---|---|---|---|---|---|---|
| | | | | | | temperatures taken. |
| | 3/20 | 60 | 200 | 153 | 10 | Hatch closed on account of rain. Only 16 temperatures taken. |
| | 3/21 | 60 | 178 | 126 | 4 | Resumed loading 1800 hr. |
| | 3/22 | 70 | 110 | 80 | — | Finished |
| 2000 hrs | 3/22 | 66 | 94 | 85 | 0 | loading and |
| | 3/23 | 59 | 212 | 108 | 9 | compacting |
| 1130 hrs | 3/23 | 69 | 208 | 139 | 18 | |
| | 3/24 | 69 | 215 | 165 | 30 | |
| | 3/25 | 68 | 212 | 159 | 33 | |
| | 3/26 | 62 | 211 | 168 | 34 | |
| | 3/27 | | | | | Hard rain all day. No temps taken |
| | 3/28 | 58 | 203 | 143 | 21 | |
| | 3/29 | 62 | 205 | 133 | 24 | |
| | 3/30 | 60 | 202 | 134 | 17 | |
| | 3/31 | 61 | 200 | 121 | 13 | |
| | 4/1 | 62 | 192 | 113 | 9 | |
| | 4/2 | 58 | 185 | 102 | 4 | |
| | 4/3 | 64 | 197 | 105 | 7 | |
| | 4/4 | 63 | 187 | 104 | 5 | |
| | 4/5 | 60 | 183 | 101 | 5 | |
| | 4/6 | 58 | 184 | 99 | 5 | |
| | 4/7 | 61 | 189 | 100 | 6 | |
| | 4/8 | 60 | 192 | 92 | 4 | |
| | 4/9 | 58 | 184 | 89 | 2 | |
| | 4/10 | 62 | 184 | 85 | 2 | |
| | 4/11 | 60 | 182 | 87 | 2 | |
| | 4/12 | 58 | 182 | 88 | 3 | |
| | 4/13 | 54 | 184 | 89 | 3 | |
| | 4/14 | 60 | 180 | 87 | 3 | |
| | 4/15 | 62 | 176 | 88 | 3 | |
| | 4/16 | 60 | 170 | 86 | 4 | |
| | 4/17 | 62 | 164 | 87 | 4 | |
| | 4/18 | 58 | 166 | 83 | 4 | |
| | 4/19 | 60 | 160 | 84 | 4 | |
| | 4/20 | 62 | 168 | 87 | 4 | |

When developing the data presented in Table 1, it was learned that a tremendous variance existed in the surface temperatures of these turnings relative to temperatures at the 10 feet and 11 feet depths, contrary to conventional wisdom. The data showed that surface temperatures taken at a depth of 8" to 14" below the surface are inaccurate as to the true temperatures in the pile.

Because of the hot turnings, it was necessary for the Pacific Sunrise to sit in port at a cost to the charterers of the vessel of over $100,000. It was expected that it would have taken up to another month for the turnings to cool below 150° F. Therefore, it was decided to try my invention by introducing nitrogen into the turnings.

Prior to my introducing inert gas into the hold, a lot of probing was done over the entire surface of the turnings 8 to determine the locus of the hot spots. We probed approximately 24 places, some at 5' depths and most at 14' depths. Temperatures varied at different depths in the same hole. Temperatures were measured by a sensing device installed at the end of a 10' rod with an additional 5' of wire with an electronic gauge at the opposite end. Impulses were received through the sensors and registered at the gauge, giving immediate temperatures. In one probe, the following temperatures recorded:

| | |
|---|---|
| 3 feet | 211° F. |
| 7½ feet | 214° F. |
| 11 feet | 308° F. |
| 12 feet | 297° F. |
| 11 feet | 334° F. |
| 14 feet | 301° F. |

When the 10' rod gauge was removed from its hole, the rod contained a heavy oil vapor residue. At the 14' depth drops of oil were actually visible on the probe. In the other probes, relatively low temperatures were found at the 5' depth, but at the 10' depth temperatures in the 270° F. to 300° F. range were found. Making these probes was very hard work as the probe had to be driven into the turnings with a heavy air hammer. All present at the test were quite shocked at the 300° F. range temperature that we were finding because almost everyone's mind was conditioned to the fact that heat rises and the maximum temperature would be expected at the surface but, with metal turnings, this appears not to be the case. This pile had a depth of approximately 20' and because the maximum temperatures lay in the 10' and 11' area, it appears that the core or center of mass of the pile is the locus of the "hot spots".

The oil vapors and fumes that rose from these deep probes in the 14' area were very powerful, and irritating to the nostrils and throat.

With reference to FIGS. 1 and 2, out of the 24 probes made, fourteen feet long, one inch diameter perforated pipes 10A, 10B, and 10C were put down in the three areas where highest temperatures were found to monitor the temperature of the pile when gas was injected later on. Ten nitrogen feeding pipes 12 were installed angled at about a 70° angle to the vertical from the hatch coaming towards the center of the hatch. Eight feeding pipes were installed before beginning introduction of nitrogen and two were installed after about 24 hours of operation. The feeding pipes 12 were 1" nominal carbon steel pipes having an orifice at about every foot along the length. The orifices were spaced around the circumference of the pipes so that gas could be introduced in all directions. The pipes were 25' long of which 22' were located below the surface of the turnings so as to be about 9' below the surface of the pile of turnings. This provided a cushion of metal turnings between the gas filled pipes and the vessel's structure. The drilling crew was assigned the task of inserting the feeding pipes on each side starting from the after coaming. This was an extremely difficult job because we were drilling at about a 70° angle; it took 4 men and air hammer to achieve the required penetration. It is noteworthy that the turnings had been dozed and levelled and compacted at approximately the 10' strata, and when the drillers hit this strata it was very difficult to penetrate it, but it was accomplished.

After the gas feeding pipes were installed, each was provided with a valve 14 and a pressure gauge 16. The nitrogen used was in liquid form in a truck 26 on the dock 28. The nitrogen was passed through a vaporizer 30 which converted it into gas and was then pumped via 1" copper conduit 34 to the feeder pipes in the pile. The feeder pipes were connected in series by 1" copper tubing 38 so that the flow of gas would be going into all 10 pipes at the same time. The pipes were maintained at the same pressure with the valves 14. A pressure gauge 39 was placed at the end of the line to determine if nitrogen was being supplied to all pipes.

At 1900 hours on April 20, all feeder pipes had been installed and connected to the gas pipe line from the truck on the pier and the unit was ready for testing and operation. The initial flow of gas through the line was at a pressure of approximately 10 PSI and a temperature of 80° F. All joints were tested for leakage and repairs were made. Once the system was found intact the pressure was increased to 85 PSI and the temperature was reduced to about minus 20° F.

The nitrogen gas was pumped continuously into the pile throughout the night. At 0700 on the morning of April 21, the following results were noted:

| |
|---|
| At control point No. 10A the temperature was reduced from about 337° to 242°. |
| At control point No. 10B the temperature was reduced from about 322° to 294°. |
| At control point No. 10C the temperature was reduced from about 283° to 268°. |

The surface temperatures in the maximum hot spots were reduced from 163° to 138°, from 168° to 127°, from 164° to 117° and from 168° to 128°.

To determine how much gas was being aerated and vented through the surface of the pile, a hatch tarpaulin was placed on the square of the hatch over the turnings to attempt to retain as much of the nitrogen gas in the pile as was possible. The ship's crew was employed to level the turnings as far as possible and then lay the tarp down. After the tarpaulin was laid a slight billowing effect was made under the tarpaulin which meant that the nitrogen was working as planned, that is, displacing the air that was in the pile. When the tarpaulin was in place, it was noted that the rate at which the turnings cooled increased.

At this time it was decided to sink the fourth probe 10D in another attempt to try to find the core, but the results of this probe were negative. The fourth probe 10D was continued to be used as a temperature monitoring station. The probe holes were capped to prevent escape of nitrogen.

At 0930 the following temperatures were recorded:

| |
|---|
| Point No. 10A was down from 240° to 224° |
| Point No. 10B was down from 294° to 229° |
| Point No. 10C was down from 268° to 257° |

At 1:30 p.m. the following temperatures were recorded:

| |
|---|
| Point No. 10A was up from 224° to 265° |
| Point No. 10B was up from 229° to 304° |
| Point No. 10C was down from 257° to 216° |
| Point No. 10D registered 230° |

At 4:30 p.m. the following temperatures were recorded:

| |
|---|
| Point No. 10A was down from 265° to 249° |
| Point No. 10B was up from 304° to 307° |
| Point No. 10C was down from 216° to 62° |
| Point No. 10D was down from 230° to 170° |

These widely fluctuating temperatures were troublesome and unexplainable. It was theorized that a central heat core existed in the pile, and the nitrogen gas was forcing the heat to take various routes. It is also possible that because of the 70° angle at which the pipes were placed in the turnings, the feeding pipes did not extend into the hot core. It was then decided in an attempt to further attack this center core to rig feed lines to the probe pipes 10 through which we were monitoring the temperatures. The probe pipes were 1" nominal diameter carbon steel pipe having orifices about every foot with the orifices circumferentially spaced around the pipe. By using the probe pipes, nitrogen gas would be introduced in the horizontal plane in addition to the vertical plane of the original feeder inserts. The probe pipes 10 were tied in to the nitrogen gas source at the tie-in point for the feeding pipes 12 as shown in FIGS. 1 and 2. For the tie-ins, one inch copper tubing 40A, 40B, and 40D was used for probe pipes 10A, 10B, 10C, and 10D, respectively. The tie-ins were effected on the upstream side of the valve 14. The feeding pipe at the tie-in point was closed off by the valve 14 and was not used in the subsequent operation. Thus, in the subsequent operation, there were six feeding pipes 12 and four probe pipes 10 used for introducing nitrogen into the pile of turnings.

The results of lateral introduction were fantastic. Temperatures began to decline rapidly. Pressure was maintained throughout the night.

Table 2 shows the temperatures measured from the period beginning 1800 hours on the evening of April 21 to 1000 hours on the morning of the 22nd:

Table 2

| | Time | | Temperature |
|---|---|---|---|
| No. 10A | 1800 | hours | 160° |
| | 2200 | " | 100° |
| | 0200 | " | 97° |
| | 0400 | " | 90° |
| | 0600 | " | 90° |
| | 0800 | " | 0° |
| | 0900 | " | 90° |
| | 1015 | " | 90° |
| No. 10B | 1800 | " | 185° |
| | 2200 | " | 156° |
| | 0200 | " | 143° |
| | 0400 | " | 97° |
| | 0800 | " | 80° |
| | 1015 | " | 80° |
| No. 10C | 1800 | " | 138° |
| | 1900 | " | 141° |
| | 2000 | " | 87° |
| | 2200 | " | 0° |
| | 0200 | " | 0° |
| | 0400 | " | 0° |
| | 0600 | " | 0° |
| | 0800 | " | 0° |
| | 1015 | " | 0° |
| No. 10D | 1800 | " | 100° |
| | 2000 | " | 115° |
| | 2200 | " | 97° |
| | 0200 | " | 89° |
| | 0600 | " | 0° |
| | 0800 | " | 0° |
| | 0900 | " | 0° |
| | 1015 | " | 0° |

Thus, this example demonstrates the utility of the present invention in quickly reducing the temperature of a pile of turnings in a ship's hold so that the ship can set sail.

At approximately 0930 hours Lt. Stanton of the U.S. Coast Guard, who had been constantly supervising our operation since the beginning, arrived at the vessel and was informed of the extremely positive results that had been attained. He conveyed this information to his supervisor, Captain White, who was the official Captain of the Port, and it was agreed that Federal Regulations had been complied with and the vessel was free to depart the port at its convenience. The vessel sailed at 1500 hours on Apr. 22, 1979.

In total, 17,000 gallons of liquified nitrogen were used. Gas pressure ranged from −10 to 150 PSIG and the temperature of the gas ranged from +80° F. to −20° F. Assuming a specific gravity for the liquid nitrogen of 0.8, approximately 0.19 pound of liquid nitrogen per pound of metal turnings was required.

The total cost of the nitrogen operation was approximately $15,000. It was estimated that without the nitrogen operation, the vessel would have had to remain in port for another month at a cost to the charterers of about $100,000. Furthermore, it is expected that insurance underwriters will reduce insurance rates for vessels carrying turnings, where the turnings have been treated according to my invention. Thus, the economic advantages of my invention are evident. Furthermore, if my invention had been used immediately after the turnings were loaded, or even while the turnings were loaded, it probably would have been possible to save the charterers another $100,000.

EXAMPLE 2

This example demonstrates the utility of my invention in preventing or minimizing high temperatures in a pile of turnings by introducing nitrogen while loading the turnings into a ship's hold.

Figure 3:
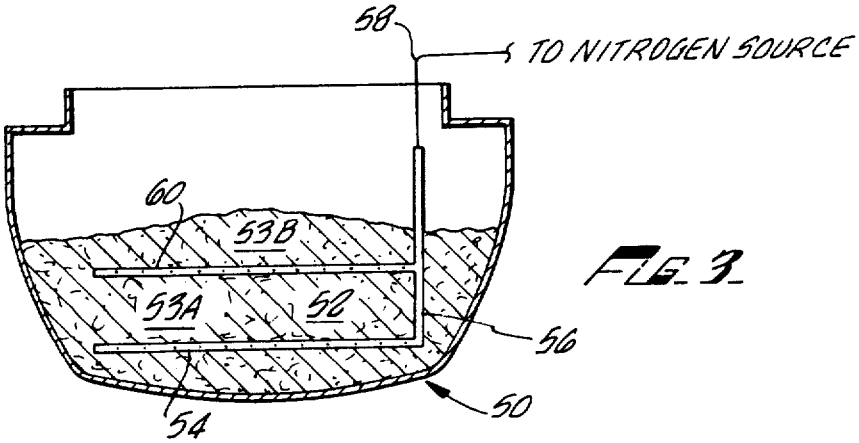
FIG. 3 is a view similar to that of FIG. 2 of a ship being loaded with turnings where nitrogen is being introduced to keep the turnings at a relatively low temperature.

FIG. 3 shows a ship's hold 50 in the middle of the loading of turnings 52 into the hold. Proximate to the bottom of the hold there is located a plurality of pipes 54 having orifices in their upper surfaces. Preferably, the pipes are cushioned with turnings placed below them. The pipes are 1" in diameter and have orifices at about every foot. The pipes are in a checkerboard grid pattern, adjacent pipes being spaced apart by about 6'. These pipes are connected to a nitrogen source by a vertical pipe 56 which is connected to the nitrogen source by 1" copper tubing 58. The gridwork is placed adjacent to the bottom of the hold and oriented substantially horizontally, and the orifices are positioned so that introduction of nitrogen is substantially only in a vertical direction. Some nitrogen is introduced horizontally, but little, if any, is introduced downwardly from this first grid of pipes 54.

As can be seen from FIG. 3, a first layer 52A of turnings have already been loaded in the hold 50 on top of the pipes 54. These turnings have been leveled and compacted by a bulldozer. On top of this first layer 52A of turnings there has been positioned a second gridwork of pipes 60, which are also connected via the pipe 56 and copper tubing 58 to the nitrogen source. These pipes 60 also have orifices, the bulk of which direct gas upwardly, but some of which direct gas both laterally and downwardly. At the stage of the operation shown in FIG. 3, the turnings are being loaded into the hold on top of the second gridwork of pipes 60, having formed a partial pile or layer 52B. The first gridwork of pipes 54 and the second gridwork of pipes 60 are spaced apart by about 6 feet.

After the second layer 52B is completed, this layer will also be leveled and compacted by a bulldozer, and a third gridwork of pipes can be placed on top of the second layer 52B. The process can then be repeated as often as necessary until a full load of pilings has been placed in the hold 50.

During the loadings of the second, third, etc. piles of turnings, not only can the most recently installed gridwork be used for introducing nitrogen, but also the earlier installed grid work of pipes can be used. This insures that the already loaded turnings near the bottom of the hold are maintained at a sufficiently low temperature so that the vessel can set sail immediately after finishing of the loading of the turnings.

Although the present invention has been described in considerable detail with reference to certain version thereof, other versions are possible. Therefore, the spirit and scope of the appended claims should not necessarily be limited to the description of the preferred versions contained herein.

What is claimed is:

1. A method for reducing the temperature of a compacted pile of ferrous turnings located in a ship's hold, the pile comprising at least 1,000 long tons, at least a portion of the pile being at a temperature higher than a selected temperature, the method comprising the steps of:

(a) driving a plurality of pipes into the pile, each pipe having at least one orifice in its wall, at least a portion of the orifices being at a level below the elevation of the center of mass of the pile;

(b) providing a source of nitrogen;

(c) introducing a sufficient quantity of the nitrogen from the source of nitrogen into the pile through the pipes and orifices to reduce the temperature of substantially the entire pile to less than the selected temperature, at least a portion of the nitrogen being introduced through orifices at a level below the elevation of the center of mass of the pile and at least a portion of the nitrogen being introduced substantially laterally into the pile; and (d) stopping introduction of nitrogen into the pile after the temperature of substantially the entire pile is less than the selected temperature.

2. The method of claim 1 including the step of measuring the temperature of the pile at a location at least 3 feet below the surface of the pile while introducing nitrogen into the pile.

3. The method of claim 1 in which the selected temperature is 150° F.

4. The method of claim 1 in which after the step of stopping introduction of nitrogen, the pipes are left in the pile.

5. The method of claim 1 including the steps of locating hot spots in the pile and introducing nitrogen directly to the hot spots.

6. The method of claim 1 in which the hatch of the hold is open to the atmosphere.

7. The method of claim 1 in which the source of nitrogen is a source of liquid nitrogen.

8. The method of claim 7 including the step of gassifying the liquid nitrogen before introducing nitrogen into the pile.

9. A method for reducing the temperature of a pile of ferrous turnings, the pile comprising at least 10 long tons of ferrous turnings, the method comprising the step of introducing an inert fluid directly into the pile at a plurality of locations in the pile, at least one of the locations being at a level below the elevation of the center of mass of the pile.

10. The method of claim 9 in which the inert fluid comprises nitrogen.

11. The method of claim 10 including the step of providing a source of liquid nitrogen for the nitrogen introduced into the pile.

12. The method of claim 11 including the step of gasifying the the liquid nitrogen for introduction into the pile.

13. The method of claim 10 in which at least about 0.01 pounds of nitrogen per pound of turnings is introduced into the pile.

14. The method of claim 10 in which from about 0.002 to about 0.2 pound of nitrogen per pound of turnings is introduced into the pile.

15. The method of claim 9 in which the pile comprises at least 2,000 long tons of turnings.

16. The method of claim 9 in which the pile of turnings has been compacted.

17. The method of claim 16 in which the pile of turnings has a mass of from about 10,000 to about 20,000 long tons.

18. The method of claim 9 including the steps of locating hot spots in the pile and introducing inert gas directly into the hot spots.

19. The method of claim 9 in which the pile is exposed to the atmosphere.

20. The method of claim 9 in which at least a portion of the inert fluid is introduced substantially laterally into the pile.

21. A method for loading ferrous turnings into a ship's hold comprising the steps of:

(a) placing inert fluid introducing means into the ship's hold;

(b) thereafter, loading turnings into the hold so as to form a pile of turnings which at least partially covers the fluid introducing means; and (c) introducing inert fluid into the pile of turnings from fluid introducing means covered by the pile.

22. The method of claim 21 in which the inert fluid is nitrogen.

23. The method of claim 22 including the step of providing a source of liquid nitrogen for introducing nitrogen into the pile.

24. The method of claim 23 including the step of gasifying the liquid nitrogen for introduction into the pile.

25. The method of claim 21 in which the step of introducing inert fluid comprises introducing inert fluid while loading turnings into the hold.

26. A method for loading ferrous turnings into a ship's hold comprising the steps of:

(a) placing first inert gas introducing means into the ship's hold at a location near the bottom of the hold;

(b) thereafter loading a first load of turnings into the hold so as to form a first pile of turnings which at least partially covers the first gas introducing means;

(c) introducing inert gas into the first pile of turnings from the first gas introducing means covered by the pile;

(d) placing second inert gas introducing means into the ship's hold on top of the first pile;

(e) loading turnings into the hold so as to form a second pile of turnings which at least partially covers the second gas introducing means; and (f) introducing inert gas into the second pile of turnings from the second gas introducing means covered by the second pile.

27. The method of claim 26 in which the inert gas comprises nitrogen.

28. The method of claim 26 including the step of compacting the first pile before placing the second inert gas introducing means into the ship's hold.

29. The method of claim 26 including the step of introducing inert gas into the second pile of turnings from the first gas introducing means.

30. The method of claim 26 wherein the first pile is exposed to the atmosphere when introducing inert gas into the first pile.

31. The method of claim 26 wherein the second pile is exposed to the atmosphere when introducing inert gas into the second pile.

* * * * *